US012172782B2

(12) United States Patent
Liang et al.

(10) Patent No.: US 12,172,782 B2
(45) Date of Patent: Dec. 24, 2024

(54) PACKAGING BOX

(71) Applicant: GUANGZHOU ARGION ELECTRIC APPLIANCE CO., LTD., Guangdong (CN)

(72) Inventors: Guoqiang Liang, Guangdong (CN); Qingchang Dai, Guangdong (CN); Haiyu Liang, Guangdong (CN)

(73) Assignee: GUANGZHOU ARGION ELECTRIC APPLIANCE CO., LTD., Guangzhou (CN)

( * ) Notice: Subject to any disclaimer, the term of this patent is extended or adjusted under 35 U.S.C. 154(b) by 344 days.

(21) Appl. No.: 17/492,689

(22) Filed: Oct. 4, 2021

(65) Prior Publication Data

US 2023/0035003 A1 Feb. 2, 2023

(30) Foreign Application Priority Data

Aug. 2, 2021 (CN) ..... 202110884732.1

(51) Int. Cl.
*B65B 61/06* (2006.01)
*B65B 31/02* (2006.01)
*B65B 41/12* (2006.01)

(52) U.S. Cl.
CPC ..... *B65B 31/021* (2013.01); *B65B 61/06* (2013.01); *B65B 41/12* (2013.01)

(58) Field of Classification Search
CPC ..... B65B 31/021; B65B 61/06; B65B 41/12
USPC ..... 53/434
See application file for complete search history.

(56) References Cited

U.S. PATENT DOCUMENTS

2018/0305164 A1* 10/2018 Smith ..... B65D 83/0864
2020/0283254 A1* 9/2020 Vegliante ..... B65H 35/0086

* cited by examiner

*Primary Examiner* — Hemant Desai
*Assistant Examiner* — Mary C Hibbert-Copeland

(57) ABSTRACT

The present disclosure relates to the technical field of packaging and discloses a packaging box including a box body, a reel, and a cutting device. The box body is provided with an accommodation cavity used for accommodating a vacuum bag roll, and is provided with a bag outlet; the reel is rotatably arranged in the box body, and is used for mounting the vacuum bag roll; the cutting device includes a cutting part which is slidably connected to the box body; a bag opening of the vacuum bag roll stretches out from the box body to the cutting part after passing through the bag outlet. The packaging box provided by the present disclosure is conducive to storage, transport, and cutting the vacuum bag rolls, meeting the requirements of the user for using vacuum bags.

7 Claims, 5 Drawing Sheets

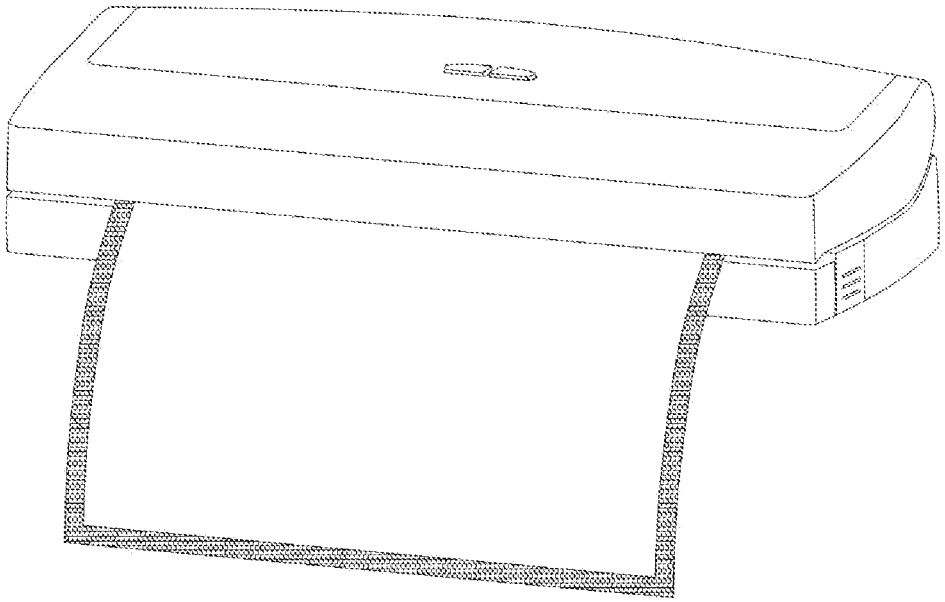
FIG. 1(PriorArt)
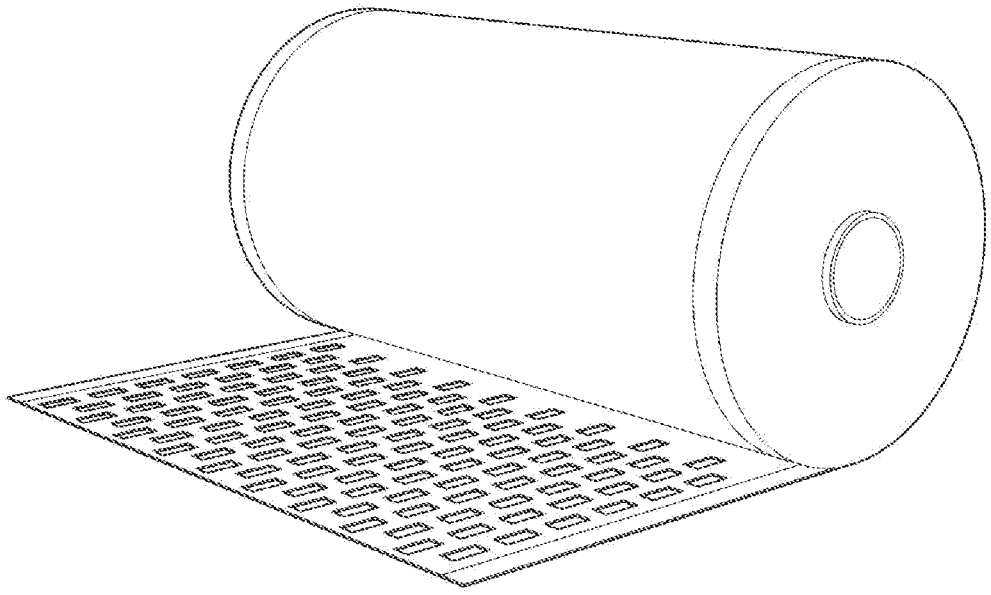
FIG. 2(PriorArt)

PACKAGING BOX

CROSS REFERENCE TO RELATED APPLICATIONS

The present application claims the benefit of Chinese Patent Application No. 202110884732.1 filed on Aug. 2, 2021, the contents of which are incorporated herein by reference in their entirety.

TECHNICAL FIELD

The present disclosure relates to a technical field of packaging, and in particular to a packaging box.

BACKGROUND

Food plays a significant role in our daily life. However, once exposed to air, food may easily get spoiled or rotten due to dampness, oxidation, or bacteria, causing severe food waste. Meanwhile, such spoiled food is harmful to the human body. In order to maintain food freshness, people have developed a vacuum packaging machine based on the principle of vacuum freshness preservation.

As shown in FIGS. 1 and 2, an external suction vacuum packaging machine is a commonly used vacuum packaging machine at present; and with the help of such external suction vacuum packaging machine and embossed vacuum bags, people can easily vacuum-package and store food in their family life and restaurant management. Before using the external suction vacuum packaging machine, an embossed vacuum bag with an appropriate length should be cut out from a vacuum bag roll according to a size of an article, so as to conveniently vacuum-package articles with various sizes. It is known that the vacuum bag roll is mainly packaged through a shrinkable film or a packaging box, which only has the packaging function. In the transportation process of the vacuum bag roll, the shrinkable film and the packaging box can only play a protective role. However, given that during use of the vacuum bag roll, a user needs to, based on the size of an article, cut out an embossed vacuum bag fitting the size of the article by himself/herself, the prior art mentioned-above still has the following technical problems:

(1) when the vacuum bag roll is used for the first time, the user needs to remove the shrinkable film or open the packaging box to take out the vacuum bag roll, leaving the vacuum bag roll exposed. Consequently, bacteria may easily gather on the surface of the vacuum bag roll, and thus contaminate the vacuum bag roll;

(2) the user needs to bring a cutter thereof to cut out an embossed vacuum bag with a required length, and when scissors or a fruit knife is used as a cutter, it is hard to guarantee that an end face of the embossed vacuum bag is flush after cutting. In this case, the embossed vacuum bag may not work very well or lacks aesthetics, leading to a waste of the embossed vacuum bag; and (3) after cutting the vacuum bag roll, the user needs to store the vacuum bag roll with the original packaging box or another packaging box, thereby greatly reduces the operational convenience of the user.

To address the above-mentioned technical problems, a new vacuum packaging machine is launched on the market. The new vacuum packaging machine includes a packaging machine body and a rolling bag bin arranged on the packaging machine body. The rolling bag bin is used for containing the vacuum bag roll, and is provided with a vacuum bag drawing port, a strip-shaped through hole is provided in the length direction beside the vacuum bag drawing port, a cutter is arranged in the through hole, and after a packaging bag with a required length is drawn out, the cutter can slide to cut off the vacuum bag. However, limited by the size and cost of the vacuum packaging machine, the volume of the rolling bag bin is small. The vacuum bag rolls contained in the rolling bag bin generally have a length of 6 m, and some of them reach 15 m. In addition, the foregoing vacuum packaging machine with the rolling bag bin is not extensively used. In consideration of size and cost, the existing vacuum packaging machine on the market is not equipped with any rolling bag bin, which requires users to cut the vacuum bags with their own cutters.

SUMMARY

The objective of the present disclosure is to provide a packaging box which is conducive to storage, transport and cutting of vacuum bag rolls, meeting requirements of users for the use of vacuum bags.

To achieve the foregoing objective, an embodiment of the present disclosure provides a packaging box, comprising:

- a box body, where the box body is provided with an accommodation cavity configured to accommodate a vacuum bag roll, and is provided with a bag outlet;
- a reel, where the reel is rotatably arranged in the box body, and is used for mounting the vacuum bag roll;
- a cutting device, where the cutting device comprises a cutting part which is slidably connected to the box body;
- a bag opening of the vacuum bag roll stretches out from the box body in the cutting part after passing through the bag outlet.

According to some embodiments of the present disclosure, the packaging box further comprises a protective cover arranged on the box body, where the protective cover covers both the bag outlet and the cutting device.

According to some embodiments of the present disclosure, the box body is provided with a recessed part on which the cutting device is arranged, and the protective cover covers the recessed part.

According to some embodiments of the present disclosure, the bag outlet is arranged on the recessed part.

According to some embodiments of the present disclosure, the recessed part comprises a first side wall and a second side wall, where the first side wall is arranged at a top end of the second side wall, and an L-shaped structure is formed between the first side wall and the second side wall.

According to some embodiments of the present disclosure, the recessed part is arranged as a form of a slope.

According to some embodiments of the present disclosure, the cutting device is arranged on the second side wall, and the bag outlet is arranged at a joint of the first side wall and the second side wall.

According to some embodiments of the present disclosure, the box body comprises a left side plate, a right side plate, a front side plate, a rear side plate, and a top cover, where the front side plate, the left side plate, the rear side plate, and the right side plate are interconnected, the top cover is movably arranged at top ends of the left side plate, the right side plate, the rear side plate, and the recessed part, and a turning direction of the top cover is to turn forward; and the left side plate, the right side plate, and the rear side plate are all folded plates, and a top of the front side plate is recessed to form the recessed part.

According to some embodiments of the present disclosure, the left side plate and the right side plate are each provided with a mounting hole, an overturning part is arranged on an inner wall of each mounting hole, two opposite sides of the reel pass through the two mounting holes respectively, and an outer wall of the reel abuts against the overturning part.

According to some embodiments of the present disclosure, a first tongue is arranged at a bottom of the top cover, a first slot is arranged at a top of the left side plate, and the first tongue is inserted in the first slot;

a second tongue is arranged at the bottom of the top cover, a second slot is arranged at a top of the right side plate, and the second tongue is inserted in the second slot; and a flange is arranged at a front side of the top cover and is provided with a third slot, and the rear side plate is provided with a third tongue which is inserted in the third slot.

According to some embodiments of the present disclosure, the cutting device further comprises a guide rail fixed to the box body, and the cutting part is slidably connected to the guide rail; and the bag opening of the vacuum bag roll stretches out from the box body to the guide rail after passing through the bag outlet.

According to some embodiments of the present disclosure, the box body is provided with a slit, and the cutting part is slidably connected to the slit.

According to some embodiments of the present disclosure, a height of the bag outlet is not greater than 3 mm.

An embodiment of the present disclosure provides a packaging box which, as compared with the prior art, has the following beneficial effects:

(1) the packaging box according to the embodiment of the present disclosure comprises a box body and a reel, where the box body is provided with an accommodation cavity configured to accommodate a vacuum bag roll and is provided with a bag outlet, and the reel is rotatably arranged in the box body and is used for mounting the vacuum bag roll. Thus, the vacuum bag roll can be placed in the accommodation cavity of the box body for a long time, which is convenient for protecting the vacuum bag roll during transportation. In addition, there is no need to take out the vacuum bag roll during daily use, which not only greatly improves the operational convenience of the vacuum bag roll, but also guarantees the sanitation of the vacuum bag roll;

(2) compared with arranging a rolling bag bin for a vacuum packaging machine, the box body according to the embodiment of the present disclosure is not limited by the size or cost, and the user can set the size of the box body to be matched with that of a required vacuum bag roll according to the needs thereof, thereby meeting the requirements of the user for using the vacuum bag roll and improving the user experience in the using process; and (3) a cutting device is arranged and comprises a cutting part slidably connected to the box body, thus meeting the requirements of the user for cutting the vacuum bag roll. In this way, the packaging box is endowed with functions of packaging and cutting, and the user experience of the packaging box is improved.

BRIEF DESCRIPTION OF THE DRAWINGS

FIG. 1 is a schematic structural diagram illustrating cooperative work of an external suction vacuum packaging machine and vacuum bags in the prior art.

FIG. 2 is a schematic structural diagram of a vacuum bag roll in the prior art.

Figure 3:
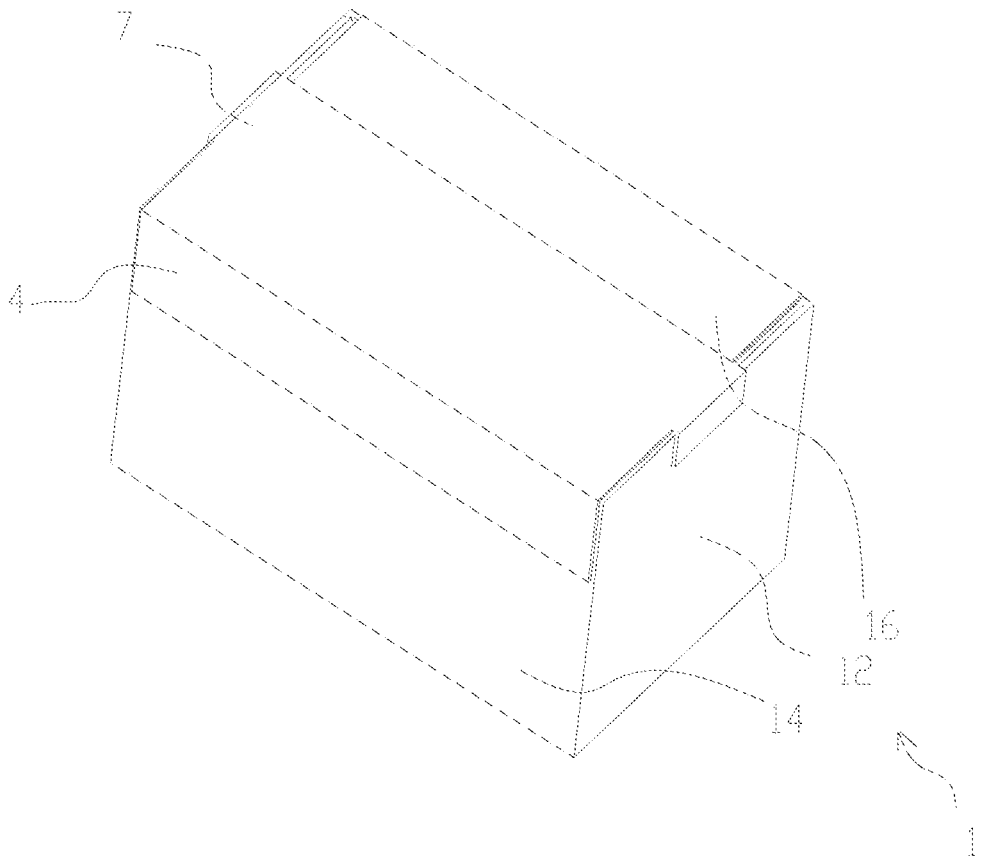
FIG. 3 is a schematic structural diagram of a packaging box according to an embodiment of the present disclosure.

In the figures there are: box body 1, accommodation cavity 11, left side plate 12, right side plate 13, front side plate 14, rear side plate 15, top cover 16, bag outlet 2, cutting device 3, cutting part 31, guide rail 32, protective cover 4, recessed part 5, first side wall 51, second side wall 52, mounting holes 6, and connecting plate 7.

DETAILED DESCRIPTION

A specific implementation of the present disclosure is now further described in detail by way of embodiments with reference to the accompanying drawings. The following embodiments are provided to illustrate the present disclosure and should not be construed as limiting the scope of the present disclosure.

In the description of the present disclosure, it should be understood that orientation or position relationships indicated by terms such as "upper", "lower", "left", "right", "top" and "bottom" are orientation or position relationships as shown in the figures. The terms are merely intended to facilitate and simplify the description of the present disclosure, rather than to indicate or imply that the mentioned device or components must have a specific orientation or must be constructed and operated in a specific orientation. Therefore, these terms should not be understood as a limitation to the present disclosure.

As shown in FIGS. 3-7, an embodiment of the present disclosure provides a packaging box comprising a box body 1, a reel, and a cutting device 3. The box body 1 is provided with an accommodation cavity 11 used for accommodating a vacuum bag roll, and is provided with a bag outlet 2; the reel is rotatably arranged in the box body 1, and is used for mounting the vacuum bag roll; the cutting device 3 comprises a cutting part 31 and a guide rail 32, where the guide rail 32 is fixed to the box body 1, and the cutting part 31 is slidably connected to the guide rail 32; where a bag opening of the vacuum bag roll stretches out from the box body 1 to the guide rail 32 after passing through the bag outlet 2.

Based on the foregoing setting, the packaging box according to embodiments of the present disclosure has the following beneficial effects:

(1) the packaging box according to embodiments of the present disclosure comprises a box body 1 and a reel, where the box body 1 is provided with an accommodation cavity 11 configured to accommodate a vacuum bag roll and is provided with a bag outlet 2, and the reel is rotatably arranged in the box body 1 and is used for mounting the vacuum bag roll. Thus, the vacuum bag roll can be placed in the accommodation cavity 11 of the box body 1 for a long time, which is convenient for protecting the vacuum bag roll during transportation. In addition, there is no need to take out the vacuum bag roll during daily use, which greatly improves the operational convenience for the user, as well as guarantees the sanitation of the vacuum bag roll;

(2) compared with arranging a rolling bag bin in a vacuum packaging machine, the box body 1 according to the embodiment of the present disclosure is not limited by the size or cost, and the user can set the size of the box body 1 to be matched with that of a required vacuum bag roll according to the needs thereof, thereby meeting the requirements of the user for using the vacuum bag roll and improving the user experience in the using process; where, it should be noted that the user can place a vacuum bag roll longer than 15 m into the box body 1; and (3) a cutting device 3 is arranged and comprises a cutting part 31 and a guide rail 32, where the guide rail 32 is fixed to the box body 1, and the cutting part 31 is slidably connected to the guide rail 32. In this way, the cutting device 3 meets the requirements of the user for cutting the vacuum bag roll, thus the packaging box is endowed with functions of packaging and cutting, and the user experience of the packaging box is improved. Additionally, the guide rail 32 plays a guiding role in the slide of the cutting part 31, and after the vacuum bag roll is cut by the cutting part 31, an end face of the vacuum bag obtained is flush, so as to ensure the aesthetics of the vacuum bag obtained after cutting.

In some embodiments of the present disclosure, the packaging box, as shown in FIG. 3, further comprises a protective cover 4 arranged on the box body 1, and the protective cover 4 covers both the bag outlet 2 and the cutting device 3. Thus, the protective cover 4 has the following advantages:

(1) the protective cover 4 can protect the cutting device 3 and a drawn-out vacuum bag roll, and prevent the cutting device 3 and the drawn-out vacuum bag roll from contacting outside objects, such that the cutting device 3 is prevented from being damaged due to collision, and the drawn-out vacuum bag roll is prevented from getting contaminated; and (2) the protective cover 4 plays a certain decorative effect on the box body 1, so as to improve the aesthetics of the box body 1.

In some embodiments, the box body 1, as shown in FIGS. 3-7, constitutes of paper boards which have the advantages of being convenient to manufacture and less costly.

Figure 5:
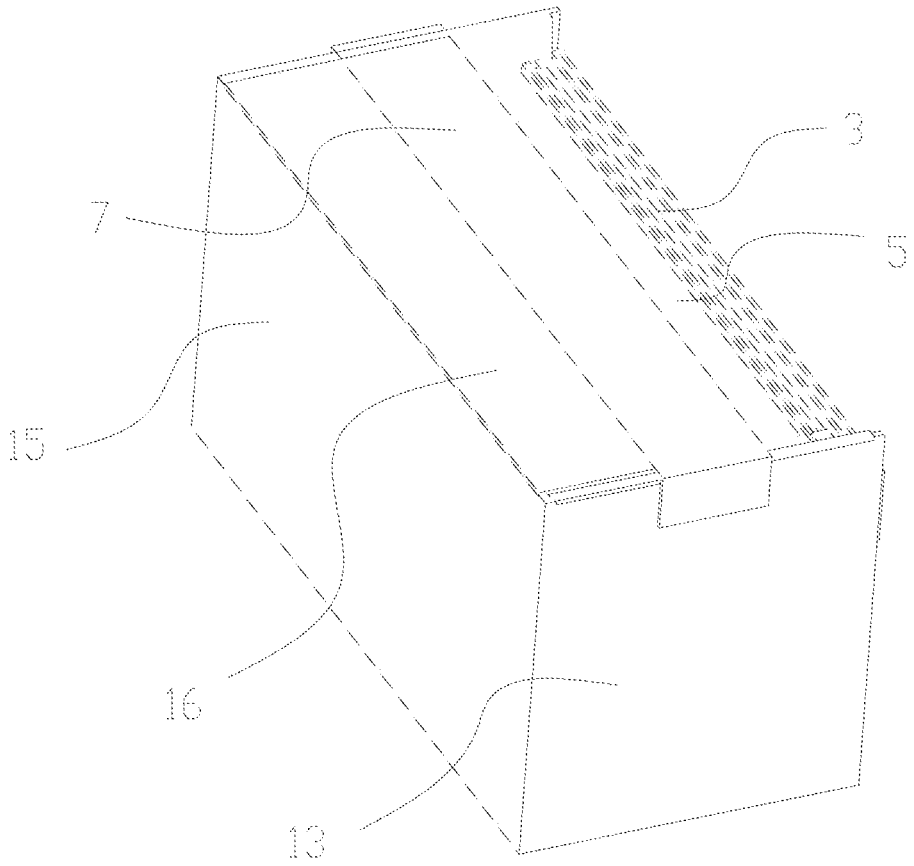
FIG. 5 is a schematic structural diagram 2 of a packaging box with a protective cover removed according to an embodiment of the present disclosure.

In some embodiments, as shown in FIGS. 2, 3, and 5, as an alternative solution, the cutting device 3 may not comprise a guide rail 32, where a slit is provided in the box body 1, and the cutting part 31 is slidably connected to the slit of the box body 1.

In some embodiments, as shown in FIG. 3, the protective cover 4 and the box body 1 adhere to each other. Therefore, in the case that the packaging box is transported or there is no need to cut the vacuum bag, the protective cover 4 adheres to the box body 1 to protect the cutting device 3 and the drawn-out vacuum bag roll; and when it is necessary to cut the vacuum bag roll, the protective cover 4 is torn off from the box body 1.

Figure 4:
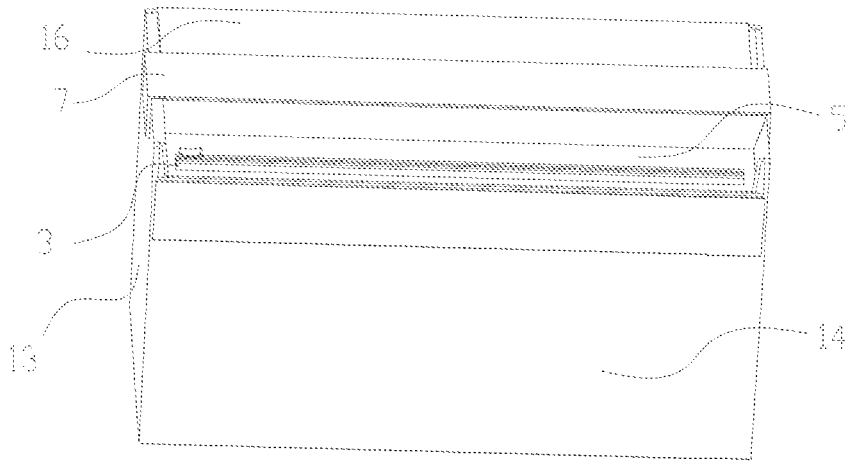
FIG. 4 is a schematic structural diagram 1 of a packaging box with a protective cover removed according to an embodiment of the present disclosure.
Figure 7:
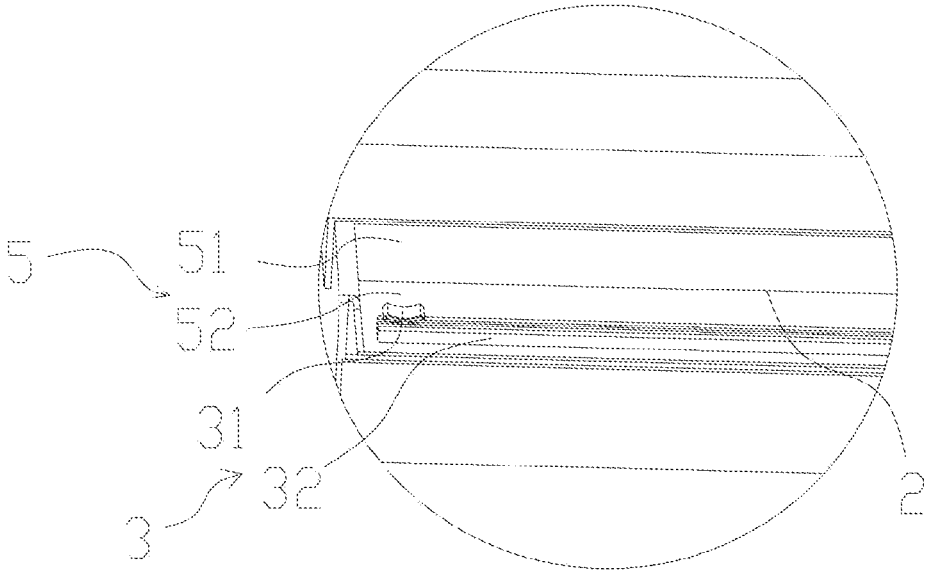
FIG. 7 is a schematic structural diagram illustrating the connection of a recessed part and a cutting device according to an embodiment of the present disclosure.

In some embodiments, as shown in FIGS. 4, 5, and 7, the box body is provided with a recessed part 5 on which the cutting device 3 is arranged, and the protective cover 4 covers the recessed part 5. Thus, the recessed part 5 is used for placing the cutting device 3 and the drawn-out vacuum bag roll so as to prevent the cutting device 3 from contacting outside objects in the transportation process of the packaging box, and to protect the drawn-out vacuum bag roll from being exposed to the outside.

In some embodiments, as shown in FIG. 7, the bag outlet 2 is provided in the recessed part 5. Therefore, compared with arranging the bag outlet 2 outside the recessed part 5, not only is the distance between the bag outlet 2 and the cutting device 3 of these embodiments shorter but also is the length of the vacuum bag roll exposed outside the box body 1 of these embodiments shorter, making the vacuum bag roll more sanitary.

In some embodiments, as shown in FIG. 7, the recessed part 5 comprises a first side wall 51 and a second side wall 52, where the first side wall 51 is arranged at a top end of the second side wall 52, and an L-shaped structure is formed between the first side wall 51 and the second side wall 52. Therefore, the recessed part 5 is a bent structure which can improve the structural strength of the recessed part 5.

As an alternative solution, the recessed part 5 can also be arranged as a form of a slope or other structural forms.

In some embodiments, as shown in FIGS. 3-6, the box body 1 comprises a left side plate 12, a right side plate 13, a front side plate 14, a rear side plate 15, and a top cover 16, where the front side plate 14, the left side plate 12, the rear side plate 15, and the right side plate 13 are interconnected, the top cover 16 is movably arranged at top ends of the left side plate 12, the right side plate 13, the rear side plate 15 and the recessed part 5, and a turning direction of the top cover 16 is to turn forward. Thus, a user can turn over the top cover 16 to check the use of the vacuum bag roll, so as to conveniently replace the vacuum bag roll as needed.

In some embodiments, as shown in FIGS. 3-5, the packaging box further comprises a connecting plate 7, a left side and a right side of the connecting plate 7 adhere to the left side plate 12 and the right side plate 13 respectively, and a top of the connecting plate 7 is connected with the top cover 16. In this way, when the connecting plate 7 adheres to the left side plate 12 and the right side plate 13, the connecting plate 7 integrates the top cover 16, the left side plate 12, and the right side plate 13 into one, thus enhancing the strength of connection among the top cover 16, the left side plate 12, and the right side plate, and then improving the compressive strength of the box body 1.

In some embodiments, as shown in FIG. 7, the cutting device 3 is arranged on the second side wall 52, and the bag outlet 2 is arranged at a joint of the first side wall 51 and the second side wall 52. Thus, compared with arranging the bag outlet 2 in other parts of the second side wall 52 (such as an upper part of the second side wall 52), the arrangement of the embodiment makes the shortest distance between the bag outlet 2 and the cutting device 3, and a length of the vacuum bag roll stretching out of the box body 1 can be shorter, so as to further guarantee the sanitation of the drawn-out vacuum bag roll.

Besides, tests show that when the vacuum bag roll is drawn out upwards, the top cover 16 may get deformed under force after the vacuum bag roll is used for a period of time, and may even be opened by out-drawing force, which shortens the service life of the top cover 16. On the contrary, the vacuum bag roll of the embodiment is drawn out forwards with a reasonable out-drawing angle, the top cover 16 is unlikely to be lifted under force of drawing out the vacuum bag roll, thereby guaranteeing the service life of the top cover 16;

moreover, when the vacuum bag roll is drawn out from the bag outlet 2, frictional force is formed between the vacuum bag roll and the first side wall 51 as well as between the vacuum bag roll and the second side wall 52 so as to make the vacuum bag roll less likely to vibrate, thereby stopping the vacuum bag roll that stretches out of the box body 1 from automatically rolling back to the accommodation cavity 11 of the box body 1.

In some embodiments, as shown in FIG. 7, tests show that when a height of the bag outlet 2 is not greater than 3 mm, frictional force between the vacuum bag roll and the bag outlet 2 is unlikely to be excessively large or small, such that the user conveniently draws out the vacuum bag roll while the vacuum bag roll is less likely to automatically roll back to the accommodation cavity 11 of the box body 1.

Figure 6:
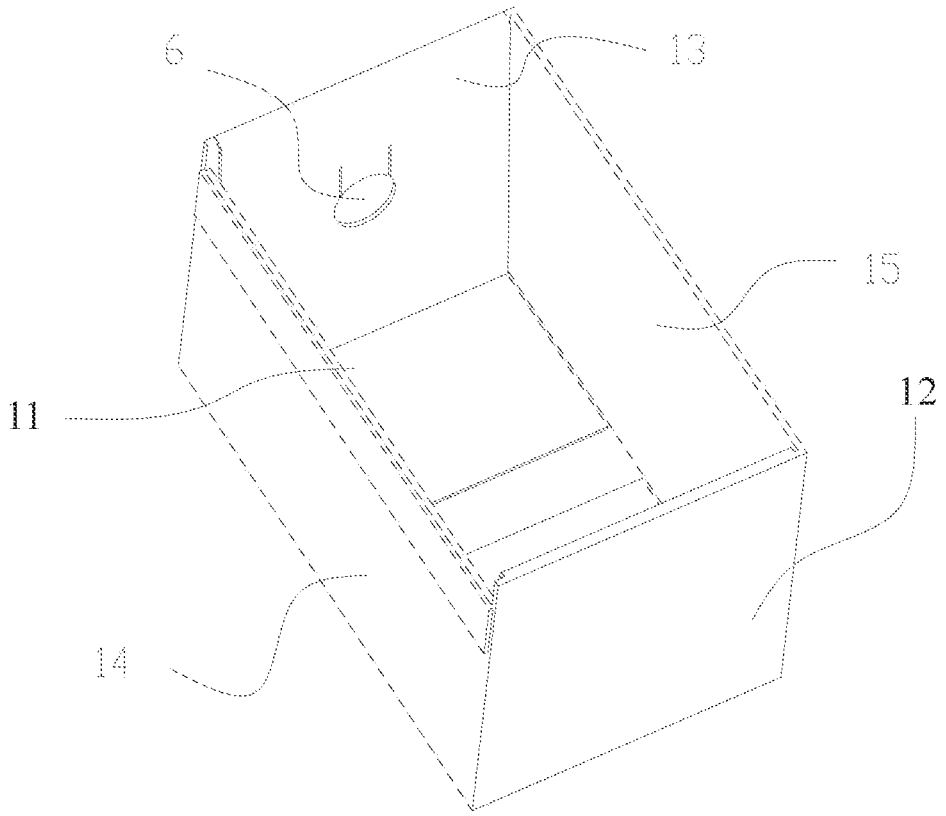
FIG. 6 is a schematic structural diagram illustrating the interior of a packaging box according to an embodiment of the present disclosure.

In some embodiments, as shown in FIGS. 4-6, the left side plate 12, the right side plate 13, and the rear side plate 15 are all folded plates, and a top of the front side plate 14 is recessed to form the recessed part 5. Therefore, the left side plate 12, the right side plate 13, the rear side plate 15, and the front side plate 14 are all bent structures, thereby improve the structural strength and the compressive strength of the box body 1; besides, an internal pit inside the box body 1 is not exposed, so as to improve the aesthetics of the box body 1.

As an alternative solution, the box body 1 may not be provided with the recessed part 5, the cutting device 3 is arranged at a top end of the box body 1, and the protective cover 4 is arranged at a top end of the box body 1 and covers the cutting device 3 and the bag outlet 2 so as to protect the cutting device 3 in the transportation process;

illustratively, the protective cover 4 may be paper boards, foam, or other materials.

In some embodiments, as shown in FIG. 6, the left side plate 12 and the right side plate 13 are each provided with a mounting hole 6, an overturning part is arranged on the inner wall of each mounting hole 6, two opposite sides of the reel pass through the two mounting holes 6 respectively, and the outer wall of the reel abuts against the overturning part. Therefore, as the box body 1 is very likely to vibrate in the process of using, carrying, or storing, frictional force is formed between the reel and the overturning part during mutual contact thereof, such that the reel is less likely to get loosened, and thus the vacuum bag roll is less likely to automatically roll back to the accommodation cavity of the box body 1. Accordingly, the situation that the vacuum bag roll rolls back to the accommodation cavity 11 of the box body 1 and then the vacuum bag roll needs to be drawn out again is avoided, such that the operational convenience is greatly improved for the user.

In some embodiments, as shown in FIGS. 3-6, a first tongue is arranged at a bottom of the top cover 16, a first slot is arranged at a top of the left side plate 12, and the first tongue is inserted in the first slot;

a second tongue is arranged at the bottom of the top cover 16, a second slot is arranged at a top of the right side plate 13, and the second tongue is inserted in the second slot; and a flange is arranged at a front side of the top cover 16, and is provided with a third slot, and the rear side plate 15 is provided with a third tongue which is inserted in the third slot. Therefore, through clamping between the first tongue and the first slot, clamping between the second tongue and the second slot, and clamping between the third tongue and the third slot, an integral structure is formed by the top cover 16, the left side plate 12, the right side plate 13, and the rear side plate 15, thereby improving the structural strength and compressive strength of the box body 1.

In some embodiments, as shown in FIG. 7, the cutting part 31 comprises s a slide block and a cutting knife, where the slide block is arranged at a top end of the cutting knife, and the cutting knife is slidably connected to the guide rail 32. In this way, a user slides the slide block to make the cutting knife slide along the slide rail 32 and then cut the vacuum bag roll, thereby guaranteeing that an end face of the vacuum bag obtained after cutting is flush.

In conclusion, the embodiments of the present disclosure provide the packaging box which is intended for achieving the purposes of facilitating storage, transport, and cutting the vacuum bag rolls as well as meeting the requirements of the user for using the vacuum bag rolls.

The foregoing descriptions are only preferred implementations of the present disclosure. It should be noted that several improvements and replacements may further be made by a person of ordinary skill in the art without departing from the principle of the present disclosure, and such improvements and replacements should also be deemed as falling within the protection scope of the present disclosure.

The invention claimed is:

1. A packaging box, comprising:

a box body, wherein the box body is provided with an accommodation cavity configured to accommodate a vacuum bag roll, and the box body is provided with a bag outlet;

a reel, wherein the reel is rotatably arranged in the box body, and the reel is used for mounting the vacuum bag roll; and a cutting device, wherein the cutting device comprises a cutting part, and the cutting part is slidably connected to the box body;

wherein a bag opening of the vacuum bag roll stretches out from the box body to the cutting part after passing through the bag outlet;

wherein the box body is provided with a recessed part on which the cutting device is arranged, and a protective cover covers the recessed part;

wherein the bag outlet is arranged on the recessed part;

wherein the recessed part comprises a first side wall and a second side wall, the first side wall is arranged at a top end of the second side wall, and an L-shaped structure is formed between the first side wall and the second side wall;

wherein the cutting device is arranged on the second side wall, and the bag outlet is arranged at a joint of the first side wall and the second side wall;

wherein the box body comprises a left side plate, a right side plate, a front side plate, a rear side plate, and a top cover, wherein the front side plate, the left side plate, the rear side plate, and the right side plate are interconnected, the top cover is movably arranged at top ends of the left side plate, the right side plate, the rear side plate, and the recessed part, and a turning direction of the top cover is to turn forward;

the left side plate, the right side plate, and the rear side plate are all folded plates, and a top of the front side plate is recessed to form the recessed part; and wherein a height of the bag outlet is not greater than 3 mm.

2. The packaging box according to claim 1, further comprising the protective cover arranged on the box body, wherein the protective cover covers both the bag outlet and the cutting device.

3. The packaging box according to claim 1, wherein the recessed part is arranged as a form of a slope.

4. The packaging box according to claim 1, wherein the left side plate and the right side plate are each provided with a mounting hole, an overturning part is arranged on an inner wall of each mounting hole, two opposite sides of the reel pass through the two mounting holes respectively, and an outer wall of the reel abuts against the overturning part.

5. The packaging box according to claim 1, wherein a first tongue is arranged at a bottom of the top cover, a first slot is arranged at a top of the left side plate, and the first tongue is inserted in the first slot;

a second tongue is arranged at the bottom of the top cover, a second slot is arranged at a top of the right side plate, and the second tongue is inserted in the second slot; and a flange is arranged at a front side of the top cover, and the flange is provided with a third slot, and the rear side plate is provided with a third tongue which is inserted in the third slot.

6. The packaging box according to claim 1, wherein the cutting device further comprises a guide rail fixed to the box body, and the cutting part is slidably connected to the guide rail;

wherein the bag opening of the vacuum bag roll stretches out from the box body to the guide rail after passing through the bag outlet.

7. The packaging box according to claim 1, wherein the box body is provided with a slit, and the cutting part is slidably connected to the slit.

* * * * *